US008461065B2

(12) United States Patent
Ming-Shun

(10) Patent No.: US 8,461,065 B2
(45) Date of Patent: Jun. 11, 2013

(54) STRUCTURE OF TOUCH-FASTENING ANTI-SKIDDING MATERIAL

(75) Inventor: Yang Ming-Shun, Taipei (TW)

(73) Assignee: Formosa Saint Jose Corp., Taipei (TW)

( * ) Notice: Subject to any disclaimer, the term of this patent is extended or adjusted under 35 U.S.C. 154(b) by 0 days.

(21) Appl. No.: 13/105,919

(22) Filed: May 12, 2011

(65) Prior Publication Data

US 2011/0274870 A1 Nov. 10, 2011

Related U.S. Application Data

(63) Continuation-in-part of application No. 12/618,779, filed on Nov. 16, 2009, now abandoned.

(51) Int. Cl.
*D04B 1/00* (2006.01)
*D04B 21/00* (2006.01)

(52) U.S. Cl.
USPC ..... 442/313; 442/304; 442/305; 442/312; 66/169 R; 66/170

(58) Field of Classification Search
USPC ..... 442/2, 49, 304, 305, 312, 313; 66/169 R, 66/170
See application file for complete search history.

(56) References Cited

FOREIGN PATENT DOCUMENTS

WO WO 02079557 A1 * 10/2002
WO WO 2005052235 A1 * 6/2005

* cited by examiner

*Primary Examiner* — Matthew Matzek
(74) *Attorney, Agent, or Firm* — Leong C. Lei

(57) ABSTRACT

A touch-fastening anti-skidding material includes a knitted foundation layer and a plurality of synthetic yarns that is secured together by being collectively knitted in the foundation layer. The foundation layer is formed by knitting of pliable base yarns and synthetic yarns. The synthetic yarns are knitted in U-shaped loops and the base yarns are knitted between adjacent strands of the knitted synthetic yarns to make a large area cloth. The cloth may be in a planar form without hollow opening sections or it includes open sections to facilitate air permeability. The loops of the synthetic yarns have legs extending beyond the foundation layer by a predetermined length and the synthetic yarns show rigidity strength, whereby a flexible, resilient, light-weighted, and low-cost touch-fastening anti-skidding material is formed.

1 Claim, 12 Drawing Sheets

Definition of test direction

The load and displacement curve of putting on needle punched carped

The load and displacement curve of putting on cut-pile carped

STRUCTURE OF TOUCH-FASTENING ANTI-SKIDDING MATERIAL

CROSS-REFERENCE TO RELATED APPLICATION

This is a continuation-in-part of the co-pending patent application Ser. No. 12/618,779, owned by the same applicant.

(A) TECHNICAL FIELD OF THE INVENTION

The present invention generally relates to a novel design of structure of touch-fastening anti-skidding material, which has the features of being fit for mass production and manufacture of large width surface area, flexibility, resiliency, and light weight, and also offers the advantages of high air permeability and low manufacturing costs, and is fit for combination with other materials and suitable for being bonded to various felts/rugs, flannelette, loop cloth (terrycloth) to realize touch-fastening and anti-skidding.

(B) DESCRIPTION OF THE PRIOR ART

The commonly known touch-fastener straps or hook-and-loop (Velcro) straps have the features of touch-fastening and anti-skidding. The known hook-and-loop strap is often composed of a male hook band and a female loop band. The male hook band has a surface forming a felt-like face on which a plurality of projecting hooks that has ends forming hooks is uniformly distributed. The female loop band has a surface forming a velvet-like face on which curled and entangling yarns are uniformly distributed. When the male and female bands are put together to have the felt-like face and the velvet-like faces thereof touching each other, the hooks of the felt-like face largely engage the curled and entangling yarns so as to fix the bands together. The known structure of the touch-fastener strap is effective in fixing articles to be fastened together, but the conventional touch-fastener strap suffers high manufacturing costs and difficulty in making large width products, and is only fit for continuous manufacture of small-surface-area elongate straps, making the production performance very poor. Further, the conventional touch-fastener strap is generally not pliable, making it difficult to bond to articles or materials showing a three-dimensional configuration. To overcome such problems, the present invention aims to provide a unique touch-fastening material, which can be manufactured by knitting synthetic fibers/yarns of different characteristics or synthetic fibers/yarns of different diameter sizes in order to suit the needs of different applications, wherein the length of the synthetic fibers/yarns used can be set according to the processing needed. The yarns are knitted to form a foundation layer that can be a net cloth having hollow opening sections (see FIG. 1 of the attached drawings) or a net cloth having no hollow opening sections (see FIG. 7). When the net cloth so knitted having hollow opening sections, the hollow opening sections can assume various shapes, such as circle, honeycomb, quadrangle, and other geometric shapes. The formation of the hollow opening sections provides the anti-skidding material with enhanced resiliency for stretchability and deformation in both length and width and improved air permeability. This also offers an advantageous feature of enhanced shapeability for forming a three-dimensional configuration for surface-bonding to other materials that may show three-dimensional configurations. Since the synthetic fibers/yarns are knitted in the foundation layer, all the synthetic yarns are tightly secured together without undesired separation off and thus additional adhesive layer applied to the bottom thereof for bonding purposes is not necessary. This makes the material of the present invention advantageous in view of manufacturing costs. The touch-fastening material of the present invention may also be subjected to additional processing by passing through a tunnel-shape oven, in which ends of the fibers/yarns are melt and form hooks with rounded end. The touch-fastening material of the present invention provides excellent resistance against skidding and thus offers extremely wide applications for anti-skidding material in various industries.

Thus, the present invention aims to provide a mass-productive, light-weighted, air-permeable, resiliently expandable, and structure simplified anti-skidding material that provides effective skidding resistance for various material, including felts/rugs, flannelette, and loop cloth (terrycloth).

SUMMARY OF THE INVENTION

The primary objective of the present invention is to provide a structure of touch-fastening material, which provides an anti-skidding formed by knitting, whereby the anti-skidding material is flexible and resilient, and which is formed by knitting two types of fibers/yarns of different materials and synthetic fibers/yarns together so that a knitted foundation layer is formed and comprises a great number of synthetic fibers/yarns extending therein and the anti-skidding material can be manufactured in a mass production manner with excellent features of light-weight, air permeability, resilience, and processability.

Another objective of the present invention is to provide an anti-skidding material, which possesses excellent stretchability and flexibility that offers excellent characteristics of being easily applied to a three-dimensional surface so that the anti-skidding material can be easily shaped for forming an excellent bonding surface for three-dimensional configuration.

A further objective of the present invention is to provide a touch-fastening anti-skidding material that is applicable to felts/rugs, flannelette, and loop cloth (terrycloth) for anti-skidding purposes.

To achieve the above objectives, the present invention provides a touch-fastening anti-skidding material, which comprises a knitted foundation layer and a plurality of synthetic fibers/yarns that is collectively knitted in the foundation layer and secured together. The knitted foundation layer is formed by collectively knitting two strands of pliable base yarns and synthetic yarns and allowing the synthetic yarns to extend beyond the knitted foundation layer by a given distance. The synthetic yarns possess predetermined rigidity strength, which makes the foundation layer an underside cloth that is flexible, resilient, and light-weighted, whereby when bonded to felts/rugs, flannelette, and loop cloth (terrycloth), the anti-skidding material of the present invention provides excellent resistance against skidding.

The foregoing objectives and summary provide only a brief introduction to the present invention. To frilly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
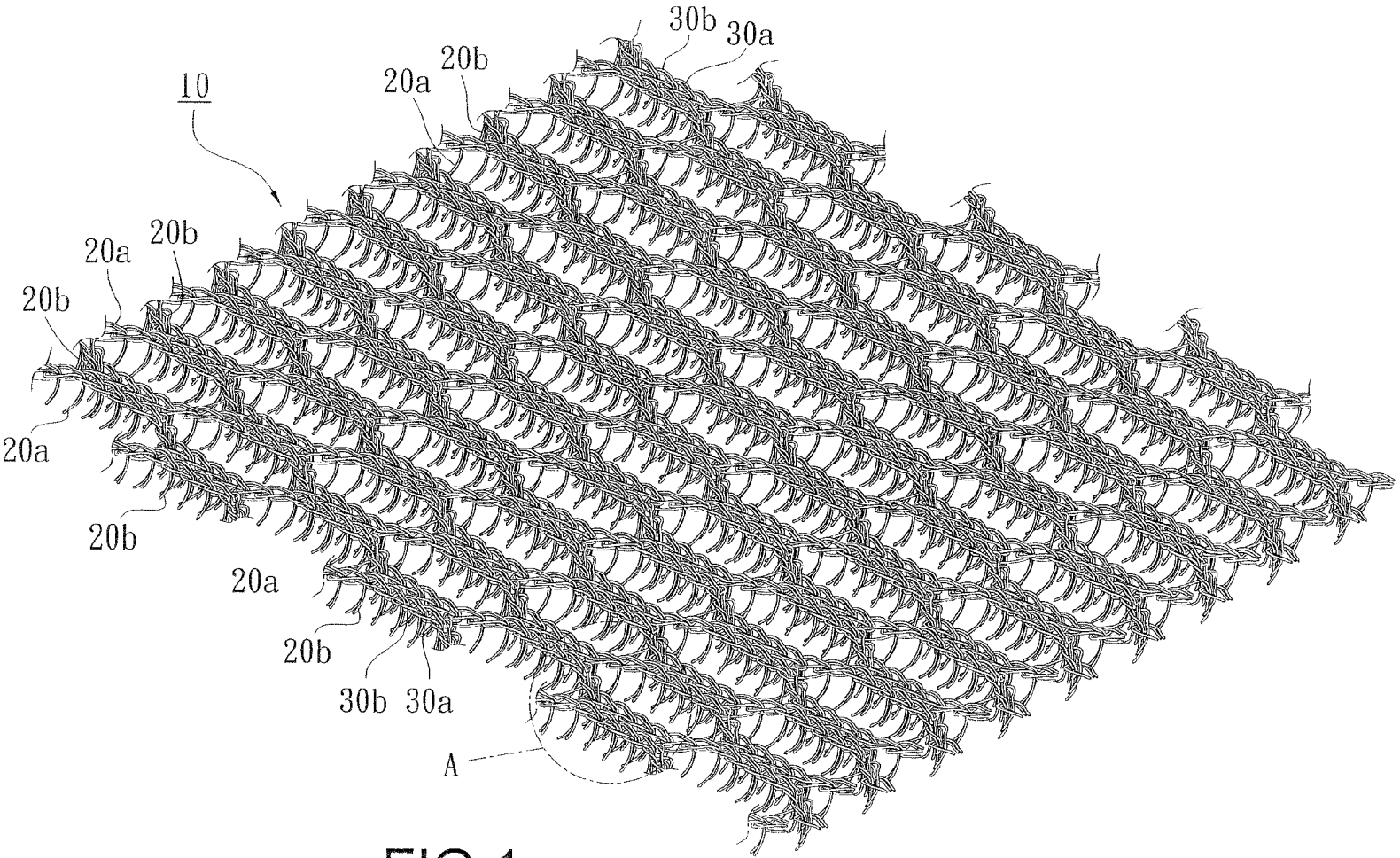
FIG. 1 is a perspective view showing a touch-fastening anti-skidding material in accordance with the present invention.
Figure 1A:
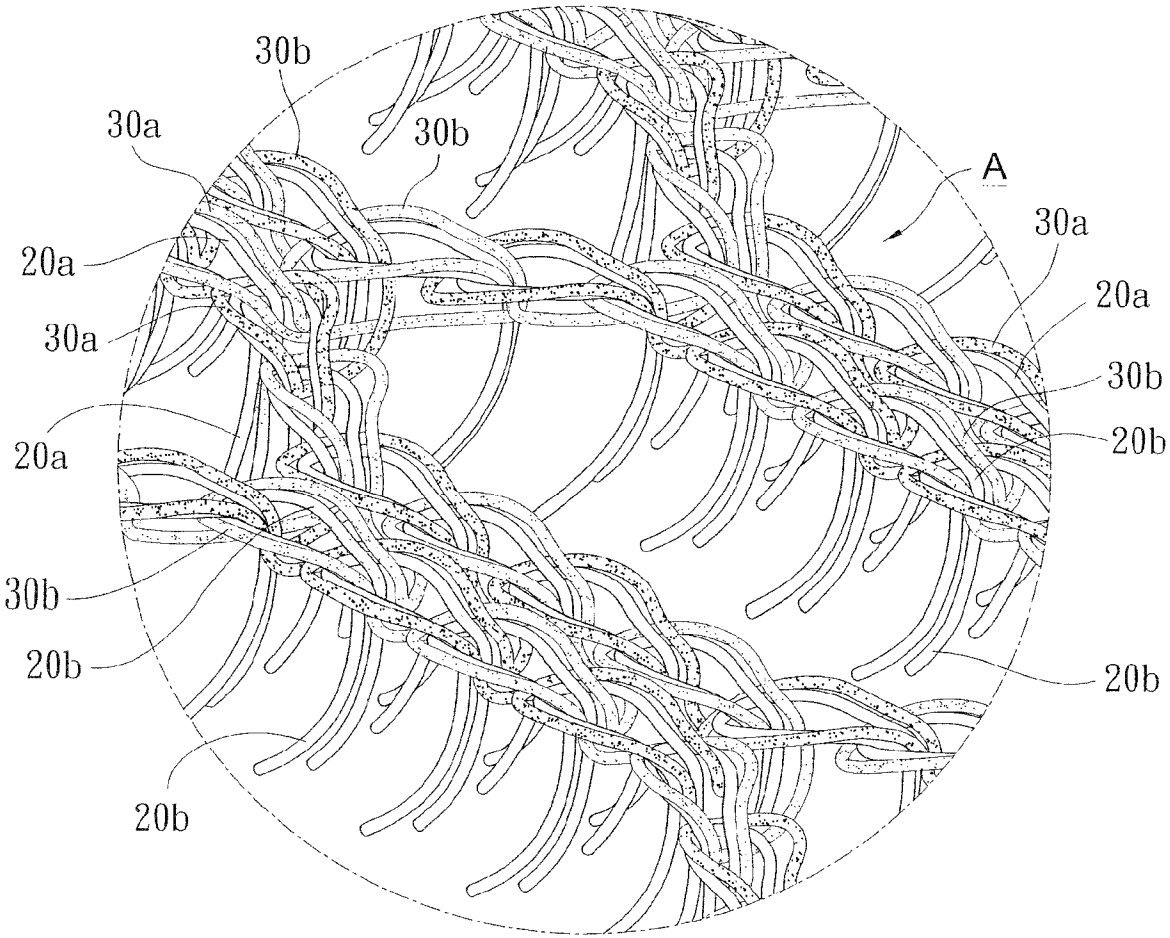
FIG. 1A is an enlarged view of a portion of the touch-fastening anti-skidding material of the present invention.
Figure 2:
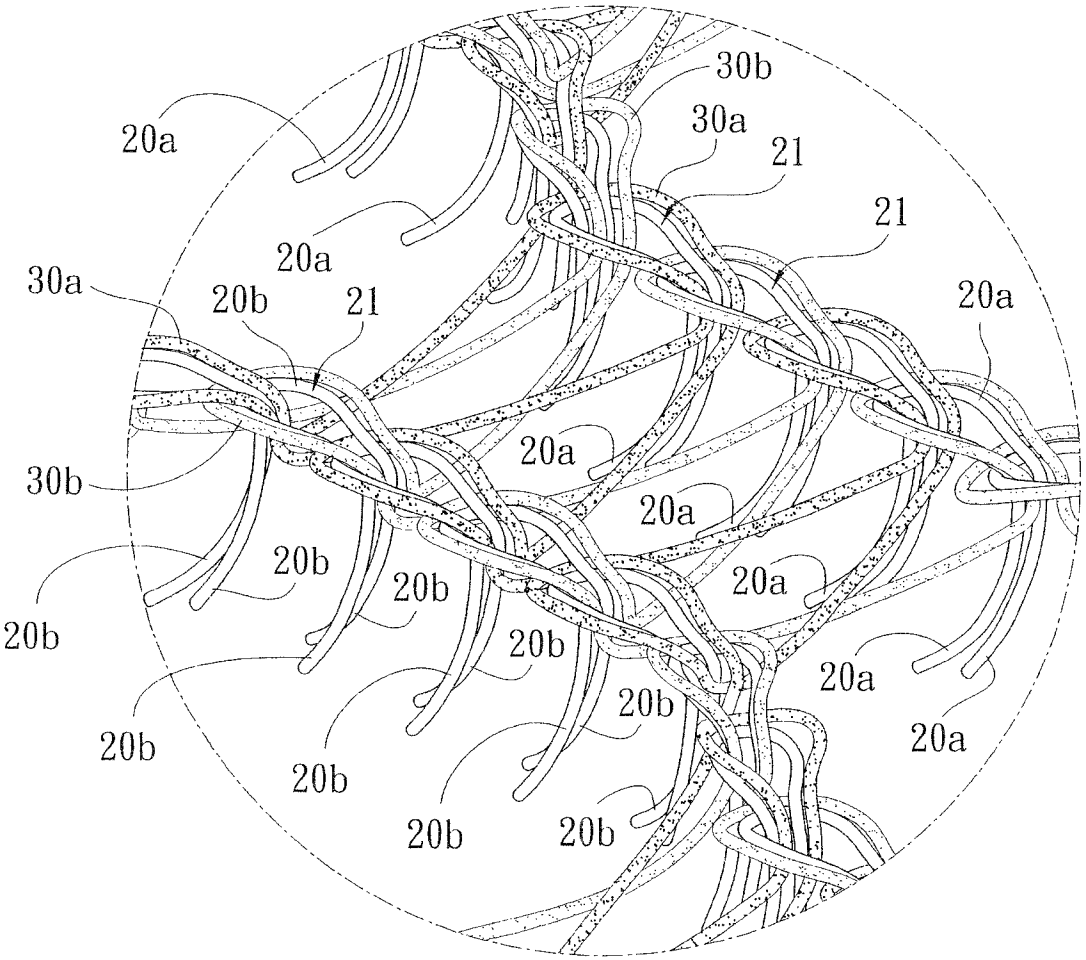
FIG. 2 is a schematic view showing a foundation layer and synthetic yarns knitted together in accordance with the present invention.

Reference is now made to FIGS. 1, 1A, and 2, in which FIG. 1 is a perspective view of a touch-fastening anti-skidding material in accordance with the present invention, FIG. 1A is an enlarged view of a portion of the touch-fastening anti-skidding material, and FIG. 2 is a schematic view showing a foundation layer and synthetic yarns knitted together in accordance with the present invention. As shown, the touch-fastening anti-skidding material in accordance with the present invention, generally designated at 10 which is manufactured by a warp-knitting machine, comprises a plurality of synthetic yarns 20*a*, 20*b* and pliable base yarns 30*a*, 30*b*.

Figure 4:
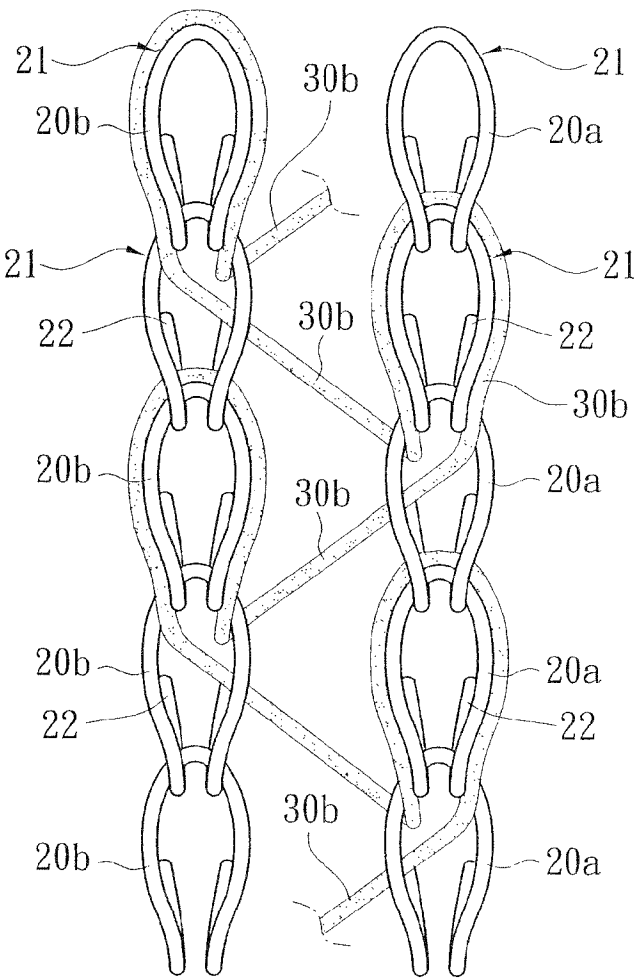
FIG. 4 is a top plan view showing another knitted arrangement of a base yarn and a synthetic yarn in accordance with the present invention.
Figure 3:
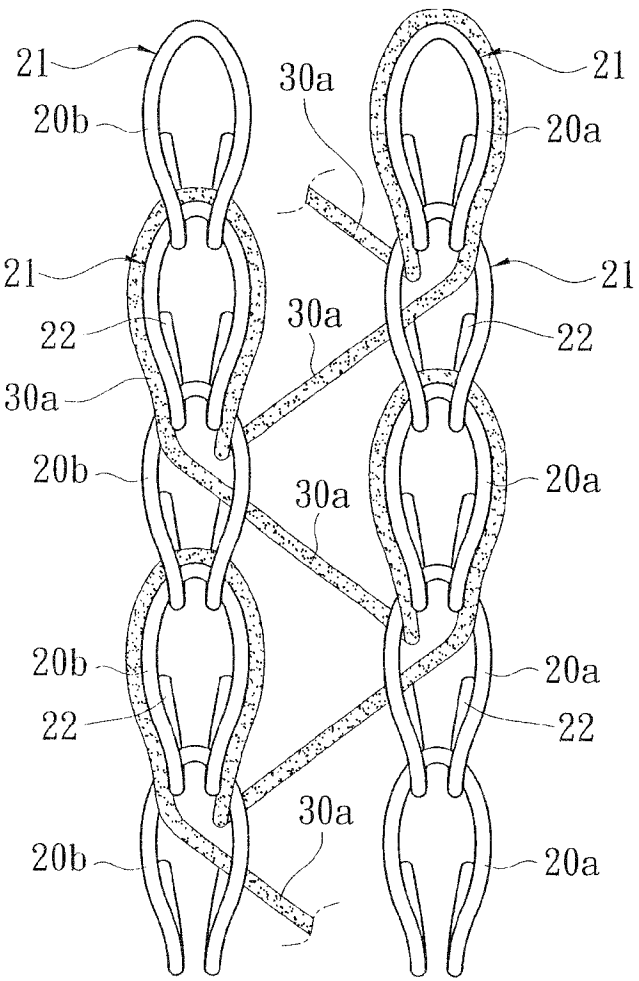
FIG. 3 is a top plan view showing a knitted arrangement of a base yarn and a synthetic yarn in accordance with the present invention.
Figure 5:
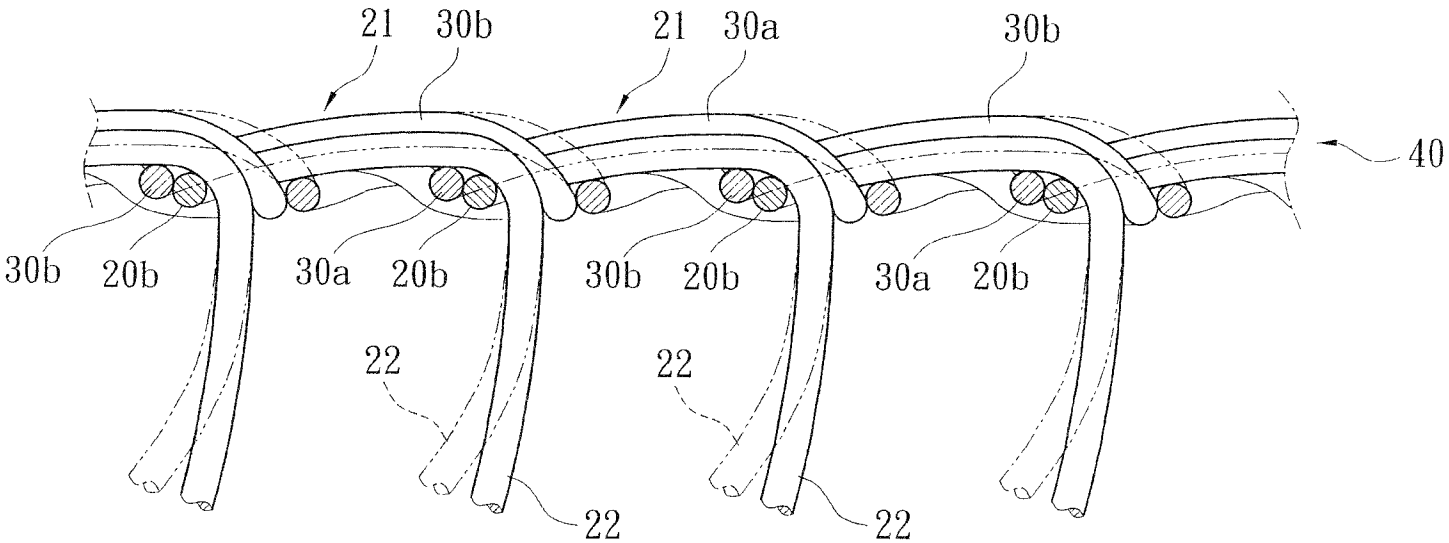
FIG. 5 is a partial cross-sectional view of the touch-fastening anti-skidding material of the present invention.
Figure 6:
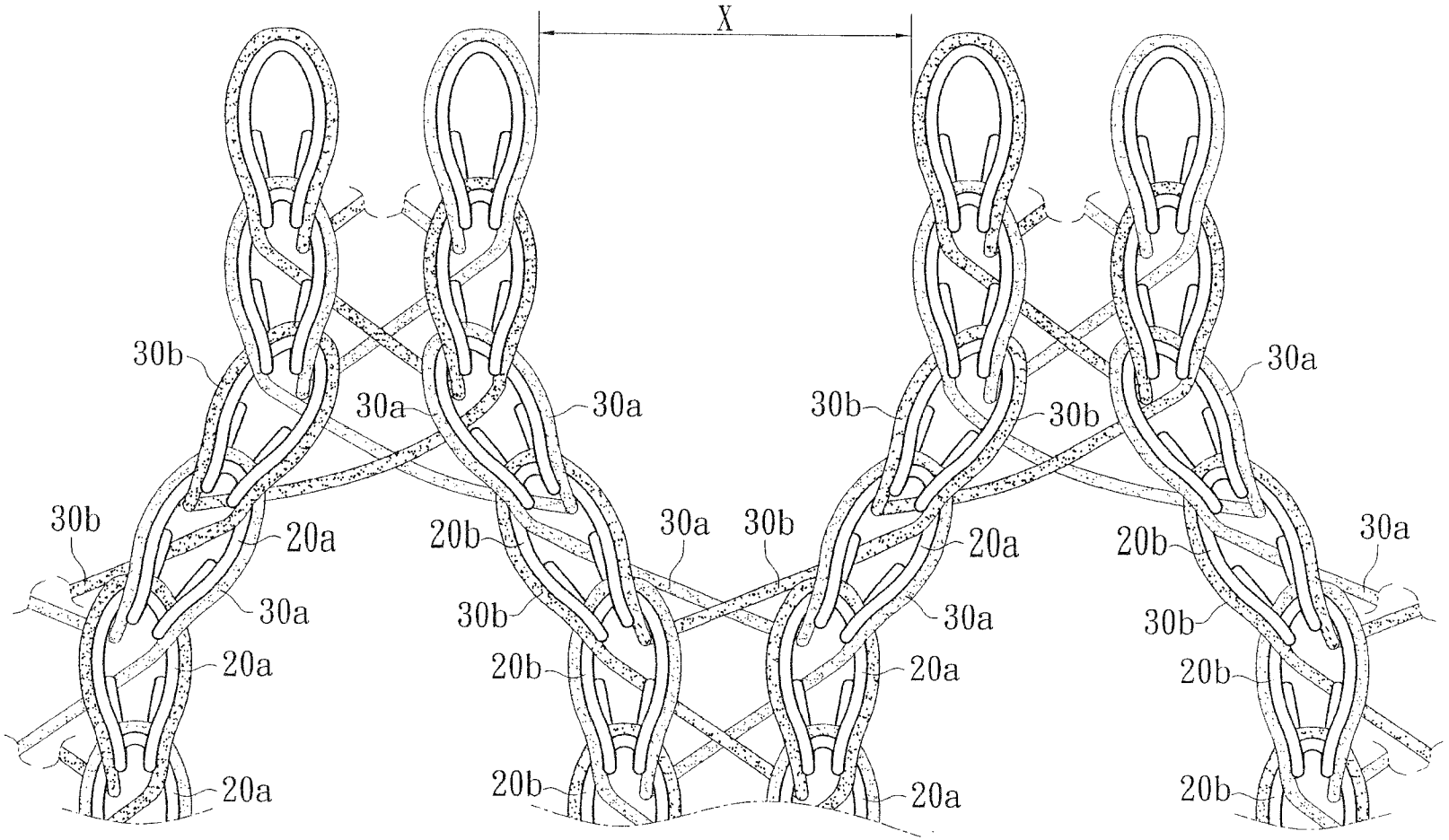
FIG. 6 is a schematic view illustrating knitting of a foundation layer of the present invention that possesses hollow opening sections.

Also referring to FIGS. 3-5, each of the synthetic yarns 20*a*, 20*b* is bent to form a U-shaped configuration, having a loop 21 (see FIG. 3) and two outward-extending short legs 22 (see FIG. 3). Each rear loop 21 loops around each front loop 21 so that the loops 21 are linked together with the short legs 22 that are located at ends of the loops 21 and of a predetermined length extending outside a foundation layer 40. The synthetic yarns 20*a*, 20*b* are accompanied by the pliable base yarns 30*a*, 30*b* in an alternate manner in the front-rear direction (see FIGS. 3 and 4) so that the first synthetic yarns 20*a* is combined with the base yarn 30*a*, while the second synthetic yarn 20*a* that is linked to the first synthetic yarn 20*a* is combined with the base yarn 30*b*. Similarly, the first synthetic yarn 20*b* is combined with the base yarn 30*b*, while the second synthetic yarn 20*b* that is linked to the first synthetic yarn 20*b* is combined with the base yarn 30*a*. In this way, two strands are collectively knitted to form a knitted strand A (as shown in FIG. 1A). The synthetic yarns 20*a*, 20*b* and the base yarns 30*a*, 30*b* are collectively knitted on a common horizontal plane and form a foundation layer 40. The base yarns 30*a*, 30*b* that are arranged to parallel accompany the synthetic yarns 20*a*, 20*b* are arranged in such a way that the base yarns 30*a*, 30*b*, after co-bent with the synthetic yarn to form the loops 21, are allowed to individually and transversely extend to and subsequently parallel accompany the synthetic yarn 20*a*, 20*b* of an adjacent strand (see FIGS. 3 and 4). The synthetic yarns 20*a*, 20*b* can be made of nylon plastics, or polyesters, or polypropylene (PP) plastics, or polyethylene (PE) plastics. The synthetic yarns are in form of monofilaments which can be knitting yarn material and have a diameter $\phi$ range between 0.02 mm-0.5 mm. In addition, the synthetic yarns have a hardness between Shore D: 40D-90D. The soft base yarns (30*a*, 30*b*) are in form of soft base yarns, the material of which can be made of processed DTY (draw texture yarn), polyester cotton or cotton yarn.

As shown in FIGS. 3-6, the base yarn 30*a*, which is arranged to co-extend with the synthetic yarn 20*a* form a loop, is allowed to extend transversely to the synthetic yarn 20*b* of the adjacent strand for subsequently co-extending with the synthetic yarn 20*b* for knitting, so that the synthetic yarns 20*a*, 20*b* and the base yarns 30*a*, 30*b* are knitted in a common horizontal plane to form the foundation layer 40. The foundation layer fabric comprises loops 21 of the synthetic yarns 20*a*, 20*b* linked to each other in the front-rear direction, so that the rear one of the loops is set to loop around the front one of the loops and each of the linked loops 21 has ends that form short legs 22 of predetermined length extending outside the foundation layer 40. When the transversely extending base yarns are of great lengths, the lengths of the base yarns allows for formation of gaps X that define hollow openings, whereby the foundation layer 40 is provided with hollow opening sections, which can be of any desired shape, such as circle, honeycomb, quadrangle, and other geometric shapes. The presence of the hollow opening sections helps improving stretchability and deformability in the longitudinal direction and the transversely direction.

Figure 7:
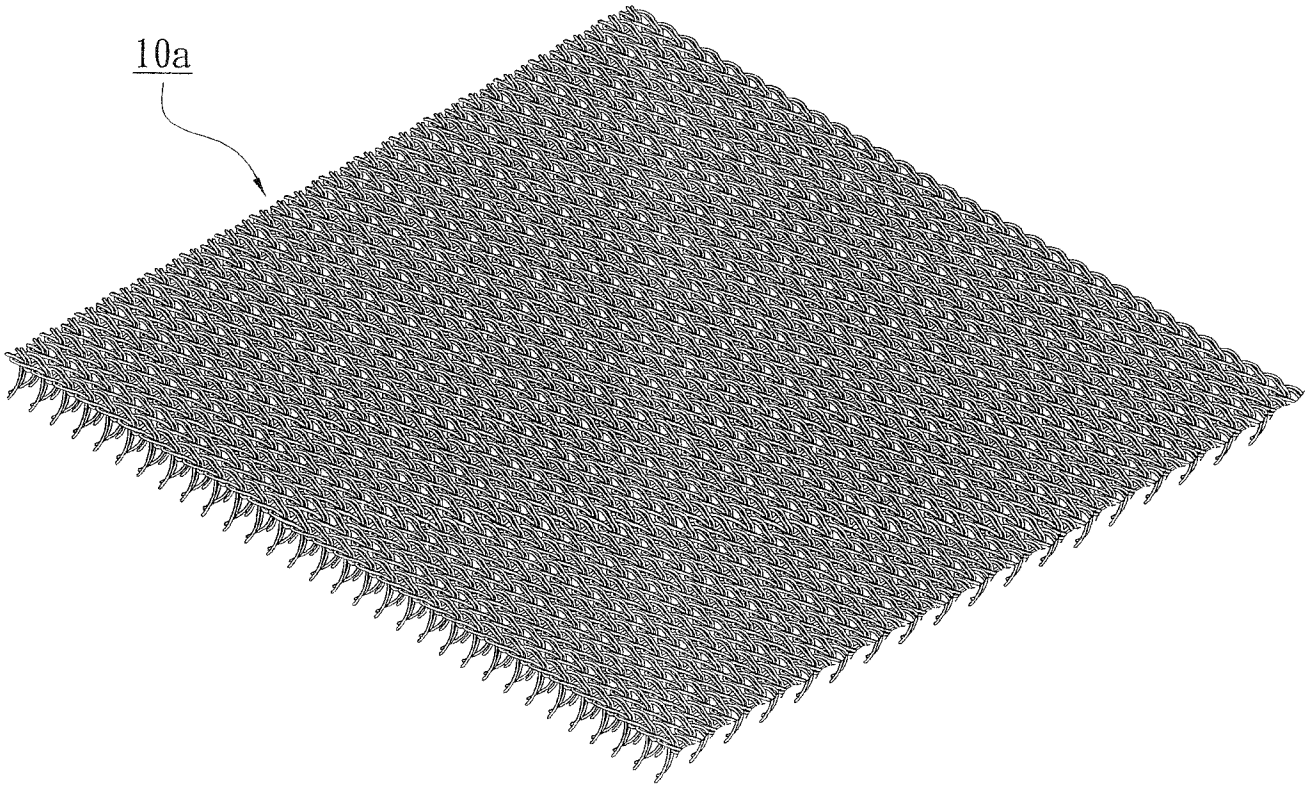
FIG. 7 is a schematic view illustrating a completely knitted foundation layer of the present invention that possesses no hollow opening section.

As shown in FIG. 7, the present invention provides a touch-fastening anti-skidding material 10*a*, which comprises a large area cloth formed by knitting of the foundation layer 40 in an expanded manner, wherein the base yarns 30*a*, 30*b* that are knitted in the foundation layer to extend transversely in the planar surface of the cloth are arranged in a tightened manner so that no gaps X that form hollow openings are formed by excessive length of the base yarns 30*a*, 30*b*. And, in this way, a planar touch-fastening anti-skidding material 10*a* is formed.

Figure 8:
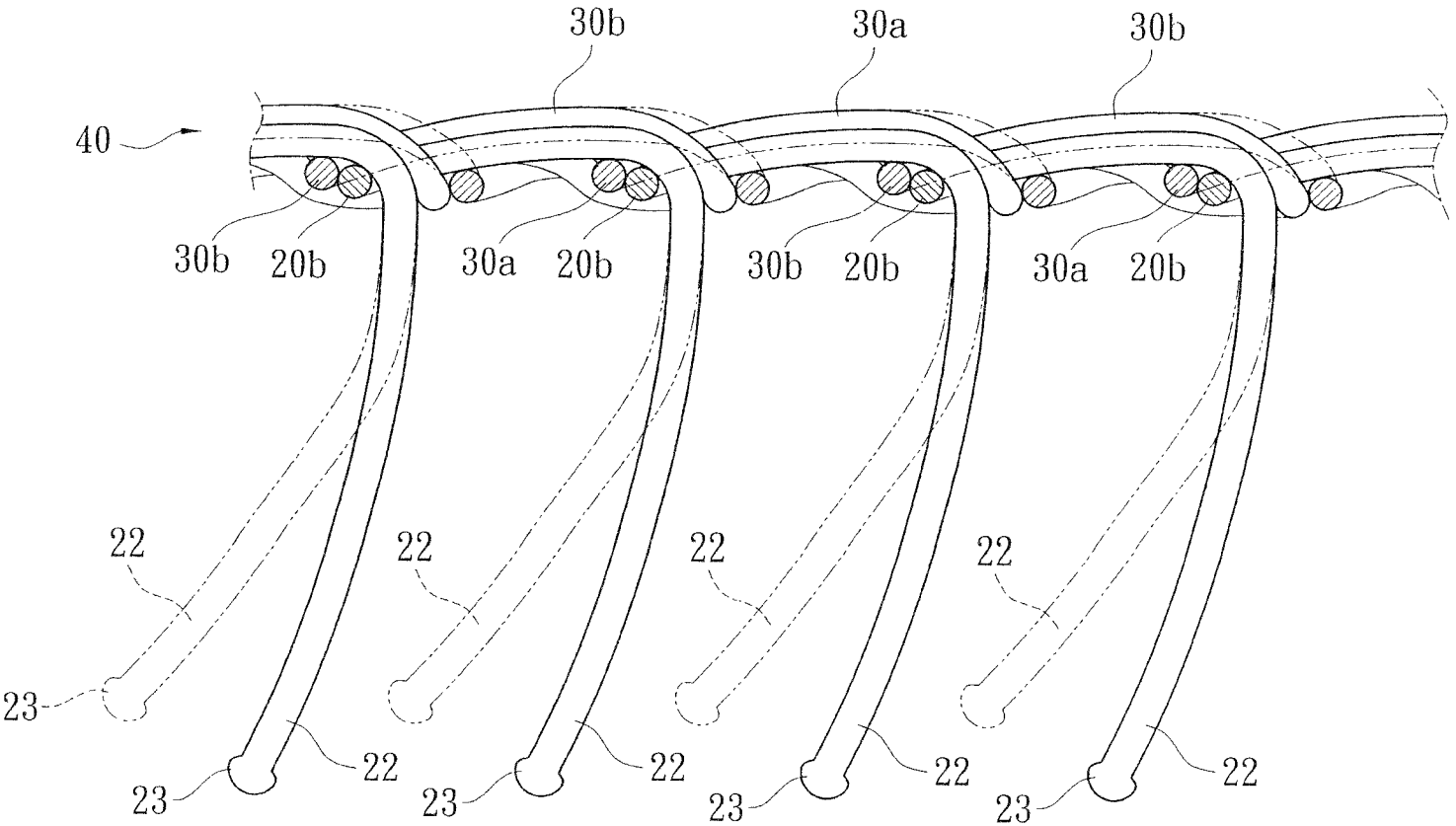
FIG. 8 is a schematic view showing legs of synthetic yarns of the touch-fastening anti-skidding material that have been subjected to heating irradiation and thus fusing.
Figure 9:
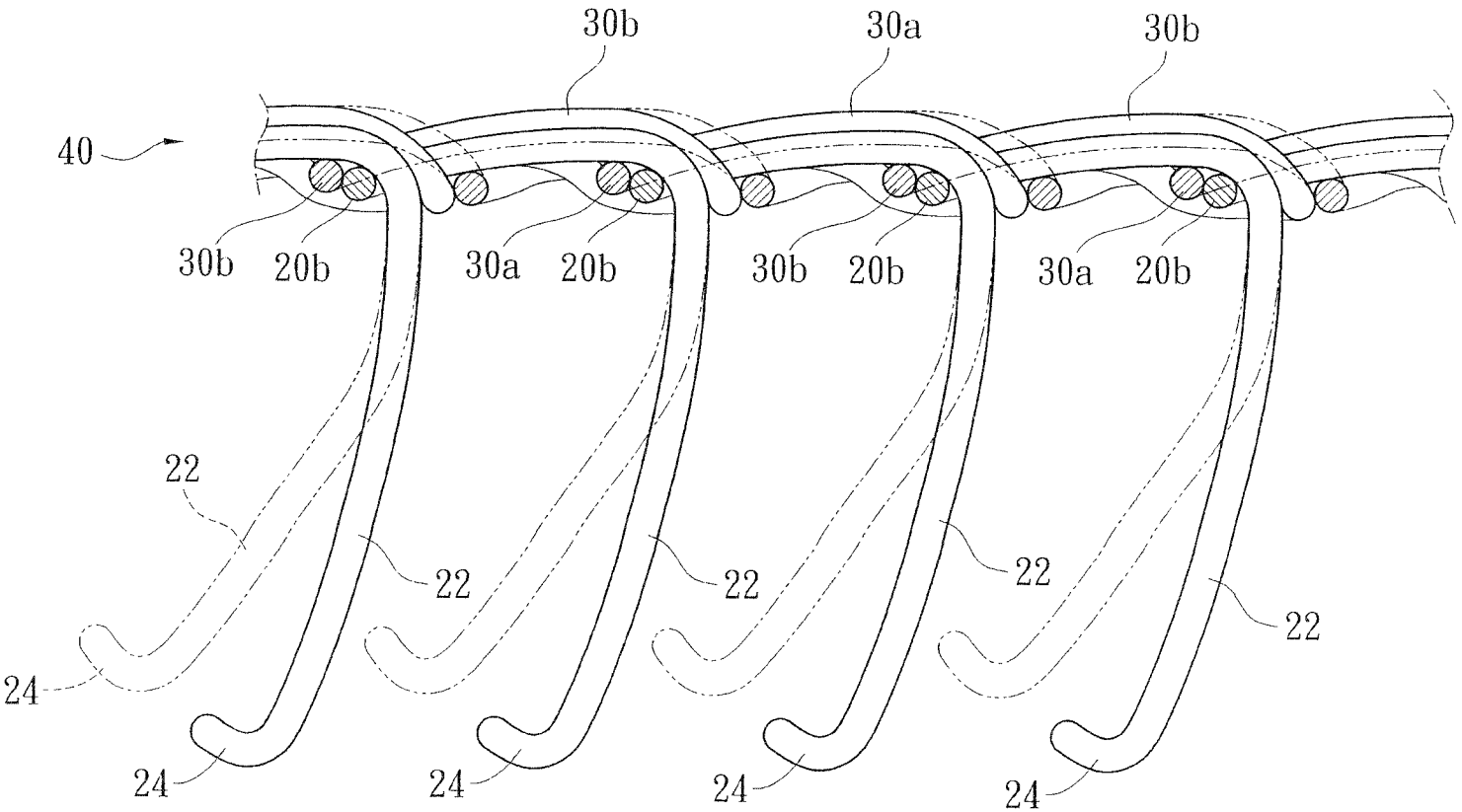
FIG. 9 is a schematic view showing legs of synthetic yarns of the touch-fastening anti-skidding material that have been subjected to heating and deformation.

Further referring to FIGS. 8 and 9, a further feature of the present invention is provided, wherein the touch-fastening material of the present invention, after being formed by collectively knitting the synthetic yarns 20*a*, 20*b* and the base yarns 30*a*, 30*b*, is further processed by passing through a tunnel-type oven for heating, whereby free ends of the legs 22 of each synthetic yarn 20*a*, 20*b* are fused to form rounded ends 23 (see FIG. 8). Alternatively, the free ends of the legs of each synthetic yarn 20*a*, 20*b* is subjected to heating and compressed to form hooks 24 (see FIG. 9). The short legs 22 of synthetic yarns extending beyond the surface of cloth so formed by knitting are set to project outside the foundation layer and the distance or length of the legs 22 of the synthetic yarns 20*a*, 20*b* can be adjusted as desired, and the synthetic yarns shows rigidity strength.

Thus, the touch-fastening anti-skidding material in accordance with the present invention possesses advantages of light weight, high air permeability, and flexibility and is fit for mass production of large width products.

To summarize, the present invention provides a touch-fastening anti-skidding material that is structured by having synthetic yarns of short lengths knitted together with the cloth that forms a foundation layer to provide the effect of anti-skidding when touching felts/rugs, flannelette, and loop cloth (terrycloth). Further, the synthetic yarns are tightly knitted together so that the synthetic yarns do not drive the yarns/velvets that make the felts/rugs, flannelette, and loop cloth (terrycloth) out and thus damage the yarns/velvets when being separated. The present invention has excellent touch-fastening characteristics and better resistance against skidding.

The following is a test report carried out by Automotive Research & Testing Center (Taiwan):

Test Lab.: Fatigue & Durability LAB.

Test Item: Pull Strength Test

Testing Category: Non-regulation

Product: Car Floor Mat

Test Condition:

Lab. Temp./Hum.: Temp.: 28° C. Hum.: 60% RH

Test Standard & Processes:

The test method is summarized as below:

Put the Car Floor Mat on needle punched carped and cui-pile carped.

Figure 10:
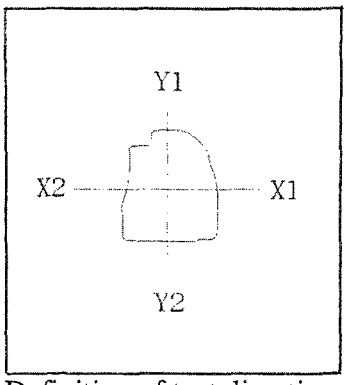
FIG. 10 illustrates the definition of test direction.

Pulling the X1, X2, Y1 and Y2 horizontal direction by 30 mm/min velocity until the Car Floor Mat slipping or the load up to 50 kgf (see FIG. 10).

Test Equipment:

15 kN Servo hydraulic actuator

Figure 11:
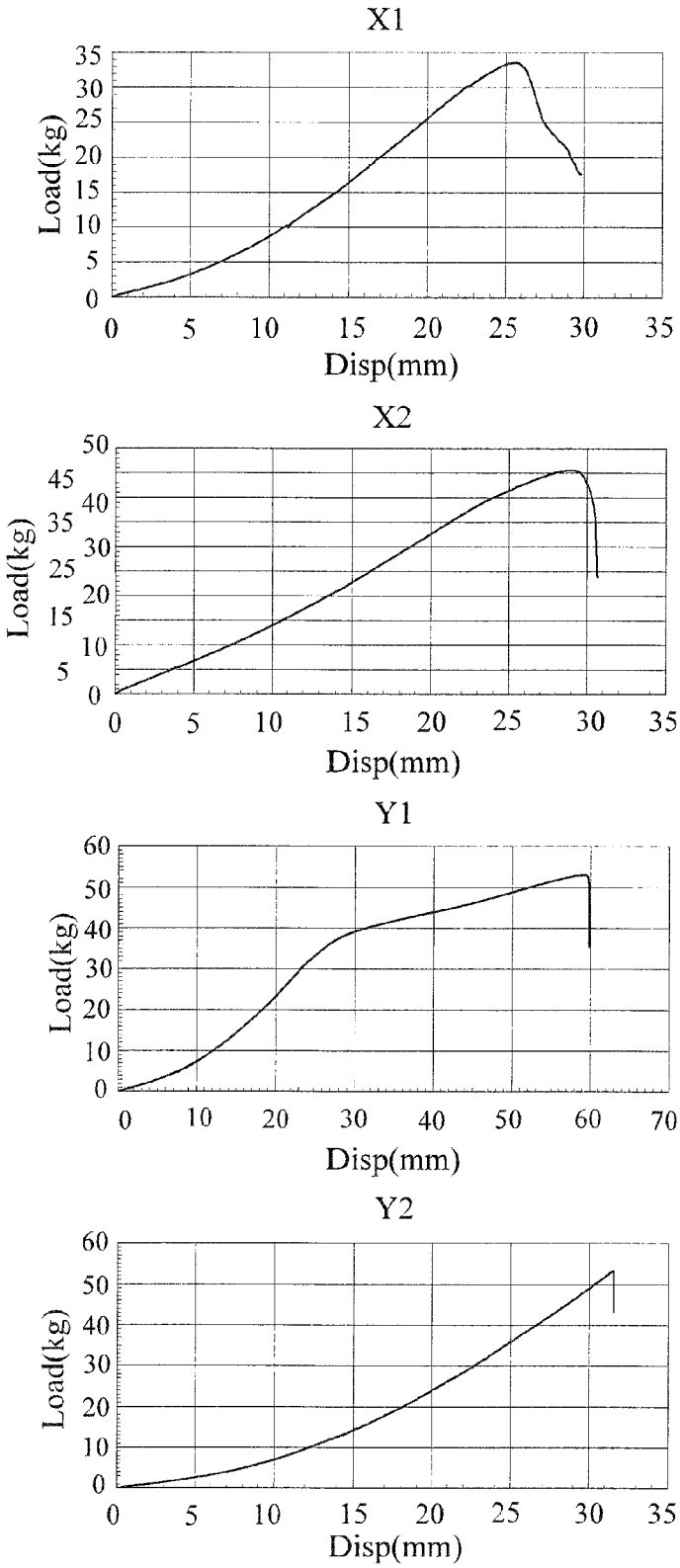
FIG. 11 illustrates the load and displacement curves of putting on needle punched carped.

Test Result:

1. The test result of putting on needle punched carped as following table:

| Serial No. | Load(kgf) | Slide or Not Slide | Test result |
|---|---|---|---|
| X1 | 34 | Slide | Shown in following curves (see FIG. 11) |
| X2 | 46 | Slide | |
| X3 | 53 | Not slide | |
| X4 | 53 | Not slide | |

Figure 12:
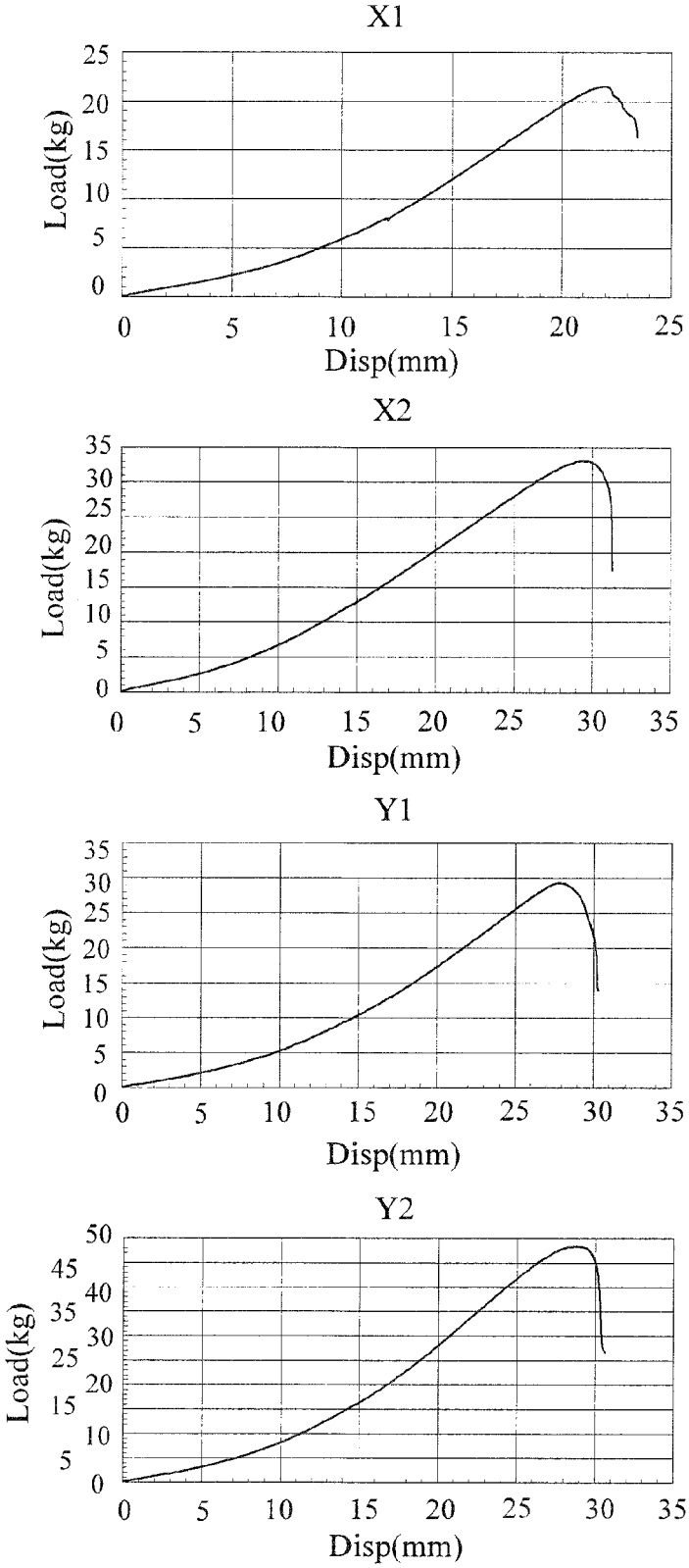
FIG. 12 illustrates the load and displacement curves of putting on cut-pile capred.

2. The test result of putting on cut-pile carped as following table:

| Serial No. | Load(kgf) | Slide or Not Slide | Test result |
|---|---|---|---|
| X1 | 22 | Slide | Shown in following curves (see FIG. 12) |
| X2 | 33 | Slide | |
| X3 | 29 | Slide | |
| X4 | 48 | Slide | |

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A touch-fastening anti-skidding material comprising a foundation layer having a plurality of synthetic yams and pliable yams knitted together, each of said synthetic yarns being accompanied by a respective one of said pliable yams, said synthetic yarns and said pliable base yams being knitted on a common plane to form said foundation layer, each of the synthetic yarns having a monofilament diameter $\phi$ range between 0.02 mm-0.5 mm and having a hardness between Shore D: 40D-90D to provide said synthetic yams with rigidity strength, said synthetic yams forming loops each having two outward-extending legs, said loops being linked to each other so that a rear one of said loops is set to loop around a front one of said loops with said two legs extending out of said foundation layer, said pliable base yarns being arranged to parallel accompany said synthetic yarns in such a way that said pliable base yarns, after co-bent with said synthetic yarn to form loops, are set to individually and transversely extend to and subsequently parallel accompany an adjacent strand of said synthetic yams, whereby a flexible touch-fastening anti-skidding material is formed.

* * * * *